US009881545B2

(12) United States Patent
Ha et al.

(10) Patent No.: US 9,881,545 B2
(45) Date of Patent: Jan. 30, 2018

(54) LED DISPLAY APPARATUS AND LED PIXEL ERROR DETECTION METHOD THEREOF

(71) Applicant: SAMSUNG ELECTRONICS CO., LTD., Suwon-si (KR)

(72) Inventors: Tae-hyeun Ha, Suwon-si (KR); Byeong-cheol Hyeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 63 days.

(21) Appl. No.: 14/798,642

(22) Filed: Jul. 14, 2015

(65) Prior Publication Data

US 2016/0078800 A1 Mar. 17, 2016

(30) Foreign Application Priority Data

Sep. 17, 2014 (KR) ..... 10-2014-0123752

(51) Int. Cl.

*H05B 37/02* (2006.01)
*H05B 37/03* (2006.01)
*G09G 3/32* (2016.01)

(52) U.S. Cl.

CPC ..... *G09G 3/32* (2013.01); *G09G 2320/0295* (2013.01); *G09G 2330/12* (2013.01)

(58) Field of Classification Search

CPC ..... G09G 3/006; G09G 2320/04; G09G 2330/12; G09G 3/32; G09G 2320/02; G09G 2320/06; G09G 2320/0295; H05B 37/02; H05B 37/03; H05B 33/0884; H05B 33/08; H05B 33/75; H05B 33/0842

USPC ..... 315/297, 307–308, 291; 362/97.1, 559, 362/561

See application file for complete search history.

(56) References Cited

U.S. PATENT DOCUMENTS

2007/0159742 A1* 7/2007 Iwabuchi ..... G09G 3/006 361/54
2008/0055211 A1* 3/2008 Ogawa ..... G09G 3/006 345/77
2013/0200821 A1* 8/2013 Yoneoka ..... H05B 37/03 315/297
2014/0354286 A1* 12/2014 Kim ..... G09G 3/006 324/414

FOREIGN PATENT DOCUMENTS

KR 10-2003-0011189 A 2/2003
KR 10-1280079 B1 6/2013

* cited by examiner

*Primary Examiner* — Jimmy Vu
*Assistant Examiner* — Henry Luong
(74) *Attorney, Agent, or Firm* — Sughrue Mion, PLLC

(57) ABSTRACT

A light emitting diode (LED) display apparatus, including: a plurality of LED lines including a plurality of LEDs; a plurality of switches connected to respective LED lines among the plurality of LED lines; a controller configured to sequentially supply power to the plurality of LED lines by sequentially turning on and off the plurality of switches; and an LED driver configured to detect an error state of an LED from the plurality of LEDs by estimating current flowing through the plurality of LED lines, and to provide the controller with a result of the detection.

16 Claims, 19 Drawing Sheets

FIG. 6C

| ID | A0 | A1 | A2 | A3 |
|---|---|---|---|---|

LED DISPLAY APPARATUS AND LED PIXEL ERROR DETECTION METHOD THEREOF

CROSS-REFERENCE TO RELATED APPLICATIONS

This application claims priority from Korean Patent Application No. 10-2014-0123752, filed in the Korean Intellectual Property Office on Sep. 17, 2014, the disclosure of which is incorporated herein by reference in its entirety.

BACKGROUND

1. Field

Aspects of one or more exemplary embodiments relate to an LED display apparatus and an error detection method thereof, and more particularly, to an LED display apparatus which may accurately detect a location of an LED element where an error occurs, and remotely determine whether or not after service (A/S) is required, and an error detection method thereof.

2. Description of the Related Art

Display apparatuses using light emitting diodes (LEDs) are known. Compared to some other display elements, LED elements have some technical advantages, such as excellent brightness, outdoor visibility, and easy scaleup.

Recently, large LED display apparatuses have been available at a relatively inexpensive price, and are widely used both indoors and outdoors. When using an LED display apparatus, it is important to determine whether or not an appropriate A/S is available when the LED display apparatus has a defect.

In the related art, A/S is provided only when a user detects a problem, and therefore, there is a drawback that the necessity of A/S cannot be determined until an operator observes or determines a current state.

In addition, when an error occurs in several LED elements among LED elements of an LED display, if there is no problem in visibility, it is not necessary to provide A/S. However, in the related art, when an LED element error occurs, it is determined that A/S needs to be provided regardless of visibility problems, and, thus, unnecessary A/S is provided. Further, self-recovery without A/S is not suggested.

In addition, in the related art, even when an LED element error is detected, information on an accurate position of an LED element where the error occurs is not known, and efficient A/S is not provided.

SUMMARY

An aspect of one or more exemplary embodiments relates to an LED display apparatus which accurately detects a position of an LED element where an error occurs by determining position information of the LED element and determining whether after service (A/S) is required, and an error detection method thereof. In addition, by adjusting a brightness of LED elements around the LED element in which the error occurs, there is provided a method for maintaining average brightness in an even manner.

According to an aspect of one or more exemplary embodiments, there is provided an LED display apparatus which includes: a plurality of LED lines including a plurality of LEDs; a plurality of switches connected to respective LED lines among the plurality of LED lines; a controller configured to sequentially supply power to the plurality of LED lines by sequentially turning on and off the plurality of switches; and an LED driver configured to detect an error state of an LED from the plurality of LEDs by estimating current flowing through the plurality of LED lines, and to provide the controller with a result of the detection.

The plurality of LEDs may include a respective anode and a respective cathode, the plurality of LED lines may include a respective plurality of LEDs with connected anodes and cathodes connected to a respective output line from among the plurality of LEDs.

The LED driver may be connected to a plurality of the respective output lines.

The LED driver may be configured to compare a current level output through the plurality of connected output lines with a threshold current value, and detect the error state of the LED based on a result of the comparison.

The controller may be further configured to detect position information of the plurality of LEDs based on an on/off state of the plurality of LED lines and an output state of the plurality of respective output lines.

The LED display apparatus may further include a communicator configured to communicate with an operating terminal.

The controller may be further configured to, in response to the result of the detection indicating that a plurality of LEDs of the plurality of LEDs have an error and the plurality of LEDs having the error being adjacently disposed in a number greater than a predetermined number, control the communicator to transmit notification information to the operating terminal.

The controller may be further configured to, in response to the result of the detection indicating that a plurality of LEDs of the plurality of LEDs have an error and the plurality of LEDs having the error being disposed in a number greater than a predetermined number within a unit area, control the communicator to transmit notification information to the operating terminal through the communicator.

The controller may be further configured to, in response to the result of the detection indicating that a plurality of LEDs of the plurality of LEDs have an error and a number of the plurality of LEDs having the error being greater than a predetermined number, control the communicator to transmit notification information to the operating terminal through the communicator.

The LED driver may include an LED driving integrated circuit (IC).

According to an aspect of one or more exemplary embodiments, there is provided an error detection method of an LED display apparatus having a plurality of LED lines which connect a plurality of LEDs in a row, the error detection method including: supplying current to one LED line from among a plurality of LED lines; measuring a current level which enters through the LED line; and detecting an LED where an error occurs from among the plurality of LEDs connected to the LED line, wherein the supplying, the measuring, and the detecting are carried out sequentially for the plurality of LED lines.

Anodes of the plurality of LEDs of the LED lines may be connected, and cathodes of the plurality of LEDs of the LED lines may be connected to a plurality of respective output lines.

The measuring may include measuring a current level output through the plurality of output lines.

The detecting may include comparing the current level measured through the plurality of output lines with a threshold value and detecting an error state of the LED based on a result of the comparison.

The error detection method may further include detecting position information of the plurality of LEDs based on an on/off state of the plurality of LED lines and an output state of a plurality of output lines.

The error detection method may further include transmitting, in response to detecting that a plurality of LEDs of the plurality of LEDs have an error and the plurality of LEDs having the error being adjacently disposed in a number greater than a threshold number, notification information to an operating terminal.

The error detection method may further include transmitting, in response to detecting that a plurality of LEDs have an error and the plurality of LEDs having the error being disposed in a number greater than a predetermined number within a unit area, notification information to an operating terminal.

The error detection method may further include transmitting, in response to detecting that a plurality of LEDs of the plurality of LEDs have an error and a number of the plurality of LEDs having the error being greater than a predetermine number, transmitting notification information to the operating terminal.

According to an aspect of one or more exemplary embodiments, there is provided an LED display including: a plurality of LED lines including a plurality of LEDs; a plurality of switches connected to a respective LED line among the plurality of LED lines; and a controller configured to switch the plurality of switches to control a supply of power to the plurality of LED lines, detect a current flowing through the plurality of LED lines, and determine whether an LED from among the respective pluralities of LEDs has an error.

The controller may be further configured to switch the plurality of switches sequentially.

The controller may be further configured to, in response to determining that a plurality of LEDs among the plurality of LEDs have the error, determine whether a repair is necessary.

The controller may be further configured to compensate for the LED having the error by controlling an adjustment of power supplied to LEDs adjacent to the LED having the error from among the plurality of LEDs.

The controller may be further configured to, in response to determining that a plurality of LEDs among the plurality of LEDs have the error, determine whether a repair in necessary based on an arrangement of the plurality LEDs having the error.

The controller may be further configured to determine location information of the plurality of LEDs having the error based on a state of the plurality of switches and the detected current flowing through the respective LED lines, and to determine the arrangement of the plurality of LEDs having the error based on the determined location information.

The controller may be further configured to determine location information of the LED having the error based on a state of the plurality of switches and the detected current flowing through the respective LED lines, and to determine the adjacent LEDs based on the determined location information.

As described above, according to various exemplary embodiments, an efficient error detection method for an LED element can be provided by detecting an LED element where an error occurs, detecting accurate position information of the element, and transmitting notification information for a specific case based on the position information. In addition, by adjusting the brightness of LED elements around the LED element where an error occurs, an average brightness may be maintained, and, therefore, a user's error recognition when viewing the LED from a distance can be minimized and a problem of uniformity of brightness can be solved.

BRIEF DESCRIPTION OF THE DRAWINGS

The above and/or other aspects of one or more exemplary embodiments will be more apparent by describing certain exemplary embodiments with reference to the accompanying drawings, in which:

FIG. 6C is a diagram of position information data according to an exemplary embodiment.

DETAILED DESCRIPTION

Figure 1:
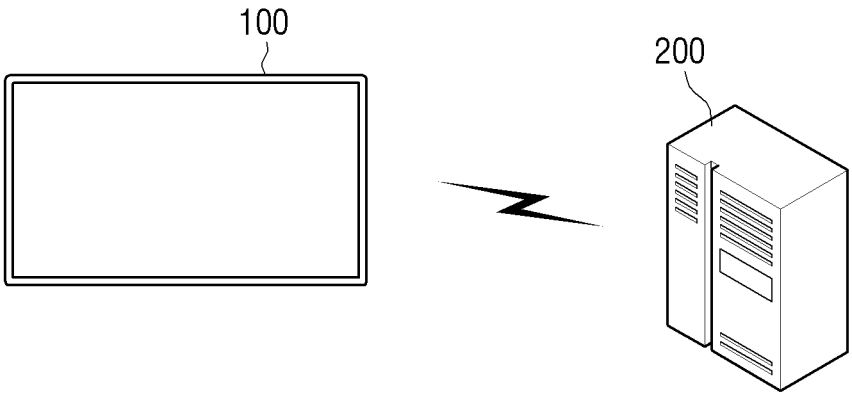
FIG. 1 is a view illustrating a remote LED detection system according to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of one or more exemplary embodiments. Thus, it is apparent that one or more exemplary embodiments can be carried out without those specifically defined matters. Also, well-known functions or constructions are not described in detail since they would obscure the disclosure with unnecessary detail.

FIG. 1 is a view illustrating a remote LED detection system according to an exemplary embodiment. Referring to FIG. 1, the LED remote detection system includes an LED display apparatus 100 and an operating terminal 200.

The LED display apparatus 100 may be embodied as various display apparatuses such as a television (TV), a monitor, and an e-frame, such as a digital photo frame. In addition, it is not necessary that the LED display apparatus 100 be embodied as a large display apparatus, and the LED display apparatus 100 may be embodied as various display apparatuses, such as a tablet personal computer (PC), a smartphone, or the like. In addition, a panel with a simple arrangement of LED elements, i.e. LEDs, may be an example of the LED display apparatus 100.

The operating terminal 200 may be embodied as a PC or a server, and may communicate with the LED display apparatus 100 with a wired or wireless connection. The operating terminal 200 may receive notification information from the LED display apparatus 100, and remotely control or monitor the LED display apparatus 100.

As described above, the LED remote detection system according to an exemplary embodiment, the LED display apparatus 100 determines whether or not there is an error, analyzes a disposition pattern of the LED elements with errors, and transmits the information to the operating terminal 200. Therefore, a user or program may remotely determine whether after service (A/S), i.e., repair or replacement, is necessary.

Figure 2:
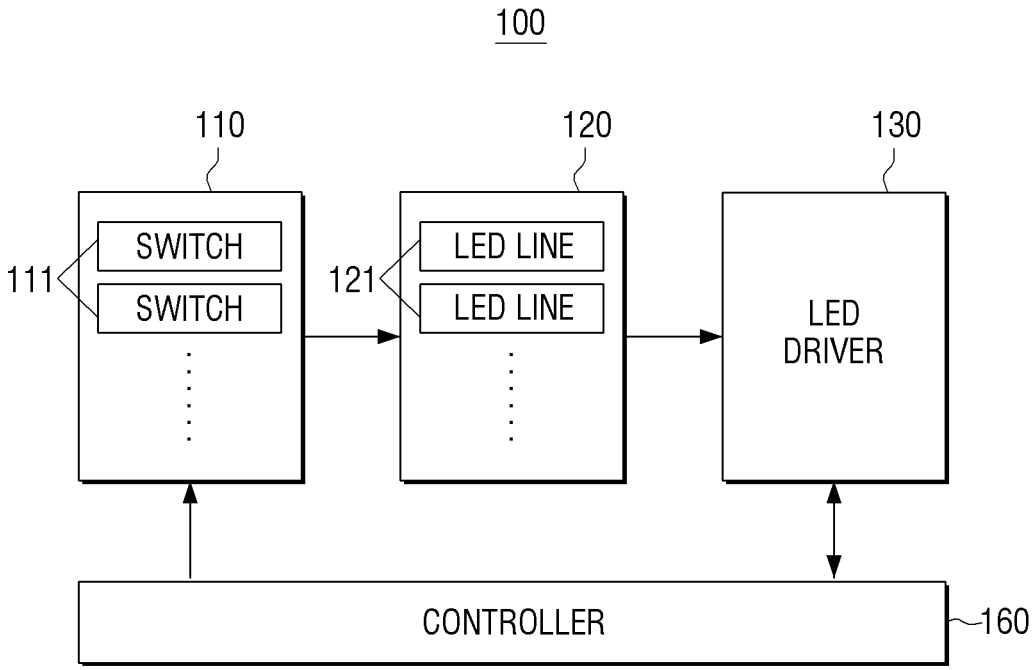
FIG. 2 is a block diagram of an LED display apparatus according to an exemplary embodiment.

FIG. 2 is a block diagram of an LED display apparatus 100 according to an exemplary embodiment. Referring to FIG. 2, the LED display apparatus 100 includes a switch 110, an LED line unit 120, an LED driver 130, i.e., an LED driving IC, and a controller 160.

The switch 110 includes a plurality of switches 111. The LED line unit 120 includes a plurality of LED lines 121. The plurality of switches are connected to correspond to the plurality of LED lines 121. The plurality of switches 111 are sequentially turned on and off, and supply current to the plurality of corresponding LED lines 121.

To each LED line (or LED array) 121, one or more LED element is connected. Anodes of each LED element are connected to the LED line (or LED array) 121 in a row, and cathodes of each LED element are connected to the LED driver 130 through an output line.

The LED driver 130 detects an error state of an LED element included in the LED line (or LED array) 121 by measuring current flowing through the plurality of LED lines (or LED array), and provides a detection result to the controller 160. For example, the LED driver 130 is connected to a plurality of output lines which connect cathodes of a plurality of LED elements, compares a current level which is output through a plurality of output lines with a threshold value, and detects an error state of each LED element according to a comparison result. As another example, the LED driver 130 may measure a current level by using an internal field effect transistor (FET) as a current detection block. Instead of comparing current level with a threshold value, a method of detecting an error based on whether current is flowing may be used.

The LED driver 130 may be embodied using a commercialized IC chip function. For example, the LED driver 130 may be embodied as a channel which can be connected to an LED element, a serial data transfer clock (SCL) line for exchanging data with the controller 160, and a chip which has a serial data line (SDA).

Alternatively, the LED driver 130 may be implemented by the controller 160.

The controller 160 controls an overall operation of the LED display apparatus 100. In particular, the controller 160 controls the plurality of switches 111 to be turned on and off sequentially to apply current to the plurality of LED lines (or LED array) 121, sequentially. In addition, the controller 160, based on the state of the plurality of LED lines (or LED array) 121 and an output state of a plurality of output lines, detects position information of each of the plurality of LED elements.

The controller 160, when the detected LED elements are adjacently disposed in a number more than a threshold value, transmits notification information to the operating terminal 200. The controller 160, when the detected elements are disposed adjacently in a number more than a predetermined number, the number of the detected LED elements in a unit area is more than a predetermined number, or an entire number of the detected LED elements is more than a predetermined number, may transmit notification information to the operating terminal 200. However, transmitting notification by the controller 160 is not limited thereto, and a predetermined condition by a user may be provided.

By the above-described LED display apparatus 100 according to one or more exemplary embodiments, an LED element where an error occurs is detected, and accurate position or coordinate of the detected LED element may be provided.

Figure 3:
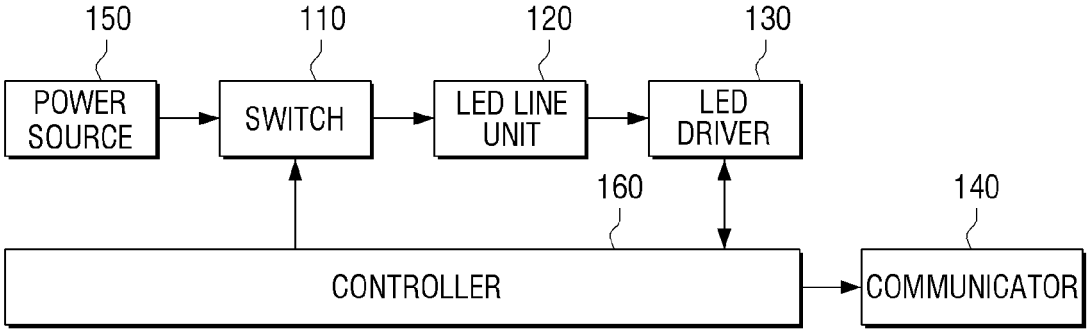
FIG. 3 is a block diagram of an LED display apparatus according to an exemplary embodiment.

FIG. 3 is a block diagram of an LED display apparatus 100 according to an exemplary embodiment. Referring to FIG. 3, the LED display apparatus 100 includes a switch 110, an LED line unit 120, an LED driver 130, i.e., an LED driving IC, a communicator 140, i.e., a transceiver, a power supply 150, i.e., a power unit, and a controller 160.

The switch 110 includes a plurality of switches that can sequentially supply current to a plurality of LED lines of the LED line unit 120 by being sequentially turned on and off. For example, the plurality of switches may be sequentially turned on and off according to a switching signal which is generated using a time multiplexing method. Therefore, the controller 160 may know error information and position information of which LED line 121 from among a plurality of LED lines (or LED array) 121 are being detected. This will be further described below. For example, the switch 110 may be embodied as a field effect transistor (FET). A gate of the FET is connected to the controller 160 and may be in a low/high state according to a switching signal. Accordingly, current is supplied or blocked from a source to a drain, and the FET operates as a switch.

The LED line unit 120 is composed of a plurality of LED lines (or LED array) 121. To each LED line (or LED array) 121, at least one LED element is connected. At least one LED element which is connected in a row to one LED line (or LED array) 121 is connected to channels of the LED driver 130 respectively, and, therefore, a position of the LED element where an error occurs may be detected from among one LED line (or LED array) 121. In addition, the controller 160 which controls an on/off state of the switch 110 may detect to which LED line (or LED array) 121 current is supplied, and thus an accurate position of the LED element where an error occurs from among the plurality of LED elements which constitute the LED line unit 120 may be obtained. For example, if an error occurs at the eleventh LED element of the third LED line (or LED array) 121, when the switch 111 which corresponds to the third LED line (or LED array) 121 is turned on, accurate position information of the LED element where an error occurs can be detected when the current level output to the LED driver 130 through the eleventh output line is less than or equal to a threshold value.

The communicator 140 receives or transmits data with an external apparatus of the LED display apparatus 100. For example, the communicator 140 may perform wired or wireless communication with the operating terminal 200. Notification information may be transmitted from the LED display apparatus 100 to the operating terminal 200 through the communicator 140. Examples of a wireless communication method used by the communicator 140 include infrared (IR) communication, ZigBee communication, Bluetooth communication, and WiFi communication.

The power supply 150 performs a function of supplying current to the LED display apparatus 100. In particular, current which is supplied through the power supply 150 may be supplied only to a specific LED line (or LED array) 121 according to on/off operation of the switch 110.

The LED driver 130 measures a current level output through an output line and detects an error state of the LED element. In addition, the LED driver 130 provides the controller 160 with an error detection result.

Figure 4:
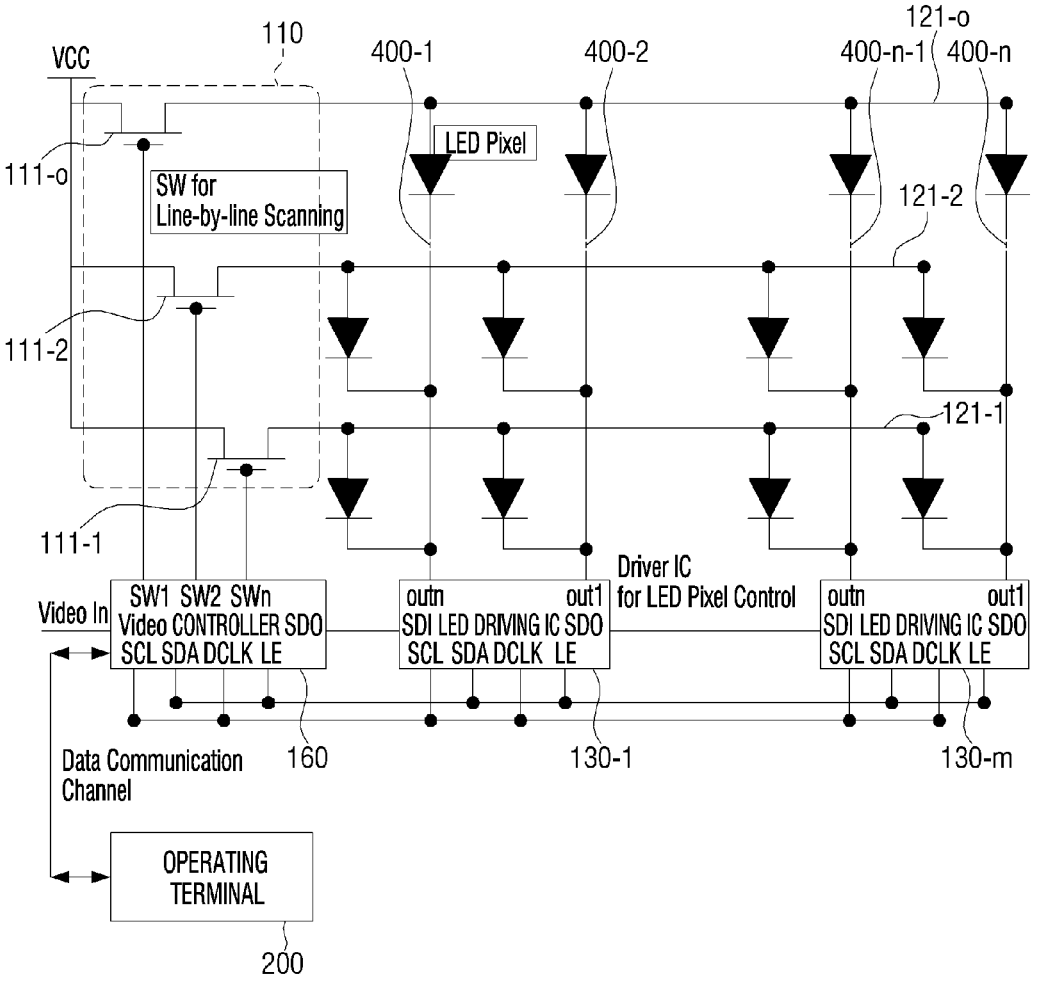
FIG. 4 is a diagram of an LED display module according to an exemplary embodiment.

FIG. 4 is a diagram of an LED display module according to an exemplary embodiment. As illustrated in FIG. 4, LED driving ICs 130-1, . . . , **130-*m* are connected to the LED in a daisy chain configuration. At each output line 400-1, . . . , 400-*n*, the LED driving ICs 130-1, . . . , 130-*m* are disposed. A plurality of switches 111-1, . . . , 111-*o* are provided to the switch 110, and are connected to corresponding plurality of LED lines 121-1, . . . , 121-*o*. At one end of the LED driving IC 130-1, the controller 160 is connected, and the controller 160 may communicate with the operating terminal 200**.

The LED driving IC 130 receives video data which is output through the controller 160 using series connection through a serial data input (SDI) pin, and, in proportion to a video level of video data, adjusts a driving current of the LED element. The LED element converts an electrical signal to an optical signal in proportion to the driving current which is adjusted by the LED driving IC 130.

The LED driving IC 130 connected in a daisy chain configuration. Out of the input video data, the video data part which is to be expressed using the LED elements which are connected to the first LED driving IC 130-1 is accepted, and remaining video data part is line shifted to a next LED driving IC 130-2. Repeatedly, out of the remaining video data, the video data part which is to be expressed using the LED elements which are connected to a current LED driving IC is accepted, and remaining video data part is line shifted to a next LED driving IC. Using this method, the LED driving IC 130 may distribute image data which is required to express one image line.

The LED driving IC 130 may detect a state of current which flows through an OUT pin provided inside of each of the LED driving IC 130 to prevent excess current flow or overheating. In the LED display apparatus 100 according to an exemplary embodiment, the current detection function may be used for error detection of the LED element.

Figure 5:
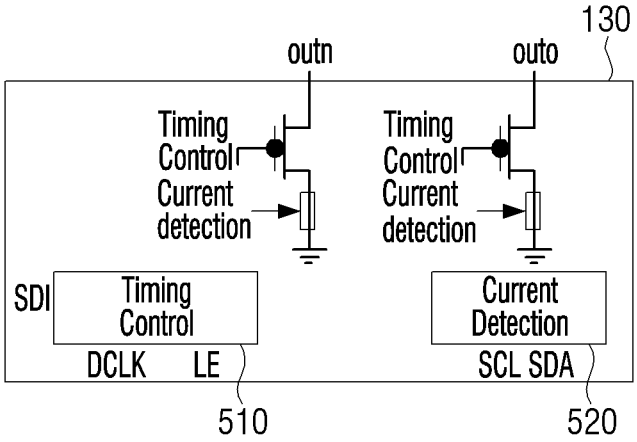
FIG. 5 is a diagram of an LED driving IC.

As illustrated in FIG. 5, the LED driving IC 130 detects an error of the LED element, and functions as a serial data transfer clock (SCK) and serial data transfer line (SDA) which may exchange data with the controller 160. As illustrated in FIG. 5, an LED driving IC 130 may include a timing control block 510 and a current detection block 520 inside the LED driving IC 130. Based on an image signal received through the controller 160 and a control signal such as a dynamic reconfiguration clock (DCLK), on/off timing of the filed effect transistor (FET) provided inside the LED driving IC 130 may be controlled, and a timing control block 510 may adjust a brightness of each LED element. A current detection block 520 may measure an amount of current flowing through the FET, and use the measurement to control current or determine an error state of the LED element. For example, the LED driving IC 130 may detect whether or not current of each LED flows through the current detection block 520, and determine an error state of the LED element. In addition, the LED driving IC 130 may transmit a detection result to the controller 160 through SCL and SDA ports. As another example, the LED driving IC 130 may detect a current level flowing in each LED element through the current detection block 520, and detect an error state of each LED element based on a comparison result.

Figure 6A:
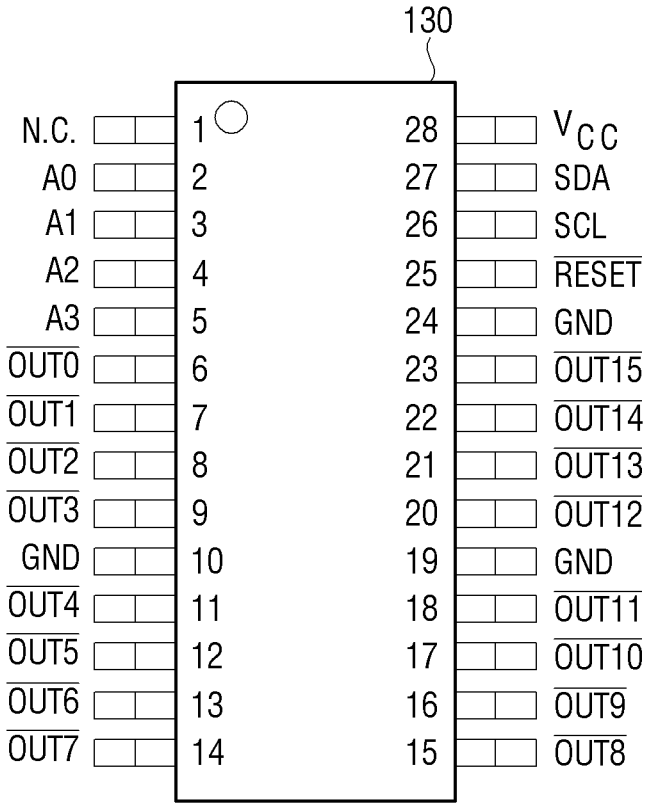
FIG. 6A is a plot plan of an LED driving IC.

FIG. 6A is a view illustrating structure of an LED driving IC 130 according to an exemplary embodiment. Referring to FIG. 6A, the LED driving IC 130 may have 16 channels from OUT0 to OUT15 which may be connected to LED elements of the LED line 121. Each channel may be connected to an output line which is connected to cathodes of the LED element. The number of available channels may be changed, and it is not necessary that all the provided channels are used. The number of output lines connected to on LED driving IC 130 may be determined based on a need. In addition, the LED driving IC 130 may have SCL and SDA ports for exchanging data with the controller 160. The LED driving IC 130 may provide the controller 160 with position information of each LED element using I2C BUS (Inter-Integrated Circuit BUS) ports A0~A3. The LED driving IC 130 may also include a not connected (N.C.) pin, a power supply pin (VCC), a reset pin, and one or more ground pins (GND).

Figure 6B:
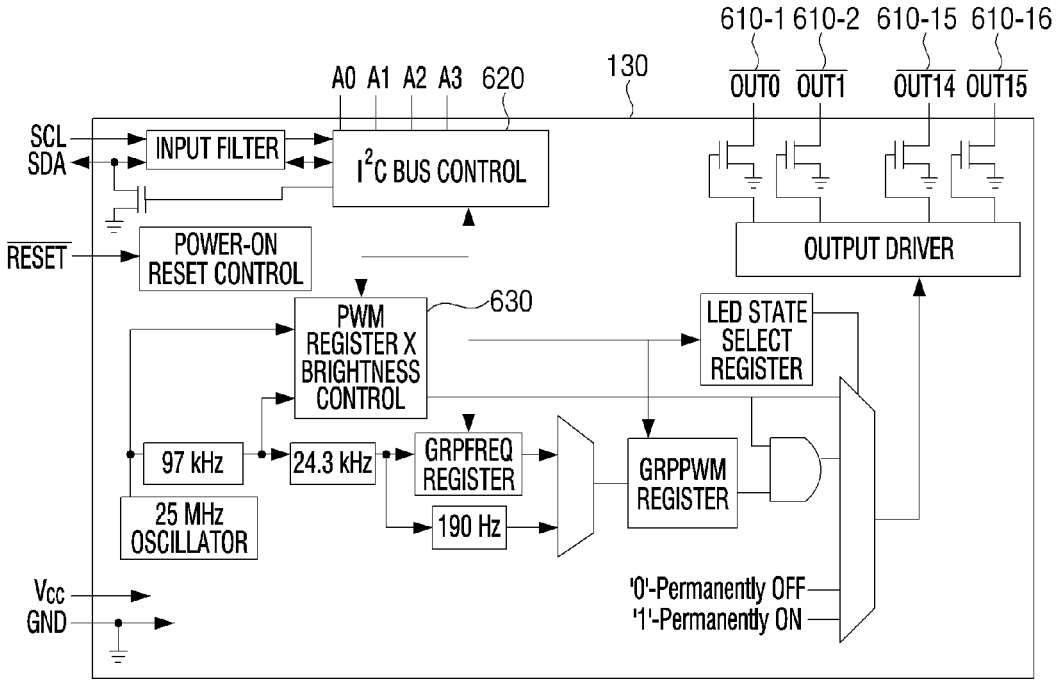
FIG. 6B is a block diagram of an LED driving IC.

FIG. 6B is a block diagram of an LED driving IC 130 according to an exemplary embodiment. Referring to FIG. 6B, the LED driving IC 130 includes an OUT port 610 connected to the output line 400 of an LED element, an I2C BUS controller 620, and a brightness controller 630.

Referring to a port which is connected to the LED elements such as OUT0 610-1 illustrated in FIG. 6B, the port may have a structure similar to the current detection block 520 illustrated in FIG. 5, and a current detection function can be provided. At a left top portion of FIG. 6B, SCL and SDA ports which may perform data communication with the controller 160 and the I2C BUS controller 620 are illustrated. The brightness controller 630 which is illustrated at a center of FIG. 6B corresponds to the timing control block 510 of FIG. 5, and a brightness of each LED element can be adjusted using the brightness controller.

FIG. 6C is an example of error detection results provided by the LED driving IC 130 to the controller 160 according to an exemplary embodiment. For example, when output lines are connected to all sixteen channels of OUT0(610-1)~OUT15(610-16), position information indicating which LED element is connected to which output line may be indicated as 4 bits of data. In addition, the LED driving IC 130 connected in a daisy chain configuration, and therefore, chip ID information may be additionally provided to indicate at which LED driving IC 130 the position information corresponds. Referring to FIG. 6C, 4 bits of position information and the chip ID is included in the position information data. In this case, the LED element where an error occurs in the LED driving IC 130 may be detected, and position information of the error can be transmitted to the controller 160.

As another example, when output lines are connected to the sixteen channels OUT0 610-1~OUT15 610-16, position information indicating the LED element is connected to which output line may be indicated as 16 bits of data. In this case, it is not necessary that an error state be determined by the LED driving IC 130, and, by comparing a current level with a threshold value and digitalizing the value, the value may be indicated as 0 or 1. Then, the value can be transmitted to the controller 160. The controller 160 may detect position information of the LED element where an error occurs based on such data.

The controller 160 includes the switch 110, the LED driving IC 130, and the communicator 140, and controls various elements of the LED display apparatus 100. The controller 160 converts an input image signal to an LED driving signal, and transmits and addresses video data corresponding to each LED driving IC 130. In addition, in order to analyze a large number of LED lines (or LED array) 121 using a small number of LED driving IC 130, the controller 160 generates a switching signal and sequentially controls an on/off state of the plurality of switches 111 connected to the plurality of LED lines (or LED array) 121 so that the plurality of LED lines 121 can be scanned using time multiplexing.

The controller 160, based on on/off state of the plurality of LED lines (or LED array) 121 and an output state of a plurality of output lines 400, may detect position information of each of the plurality of LED elements. As another example, the controller 160 may receive position information of the LED elements where an error occurs in each LED line (or LED array) 121 of the LED driving IC 130, and accurately find a position of the LED elements where an error occurs by using the on/off state of the plurality of LED lines (or LED array) 121.

Based on the position of the LED elements where an error is detected, the controller 160 may determine whether the LED display apparatus 100 requires A/S. It if appears that A/S is necessary, the controller 160 may control the communicator 150 to transmit notification information to the operating terminal 200. For example, the notification to be transmitted to the operating terminal 200 may include whether or not A/S is necessary, a position of the LED element where an error occurs, whether an error may be solved remotely, or the like.

For example, when the number of the LEDs with an error is greater than or equal to a predetermined number, it may be seen that the LED display apparatus 100 requires A/S. As another example, when the LEDs with errors are clustered and noticeable by a user, and, thus, may cause difficulty in reading information by a user or inconvenience to a user, it may be determined that the LED display apparatus 100 requires A/S.

Figure 7A:
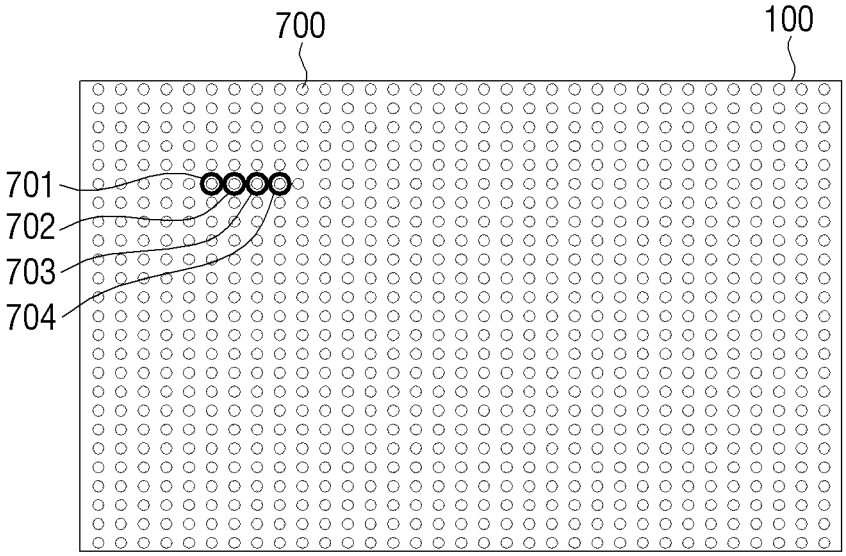
FIGS. 7A to 9 are views of various arrangements of LED elements with errors according to various exemplary embodiments.
Figure 7B:
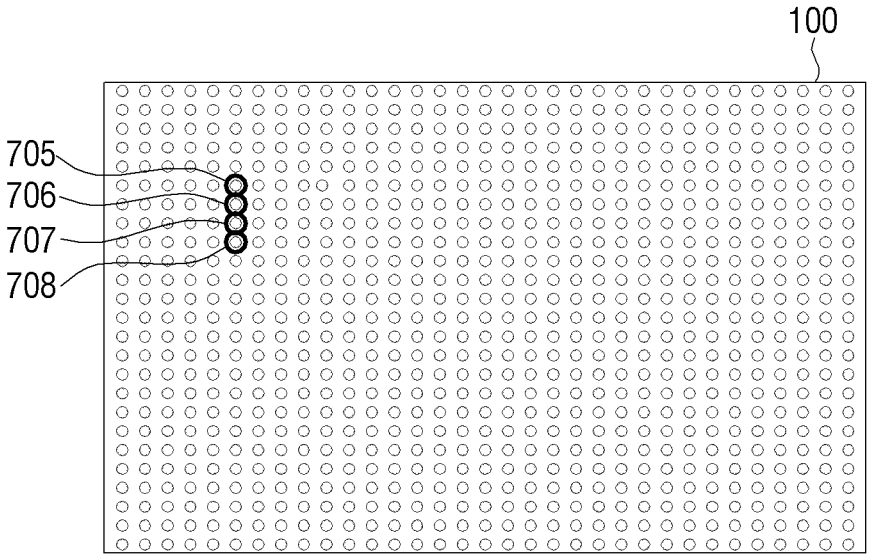
Figure 7C:
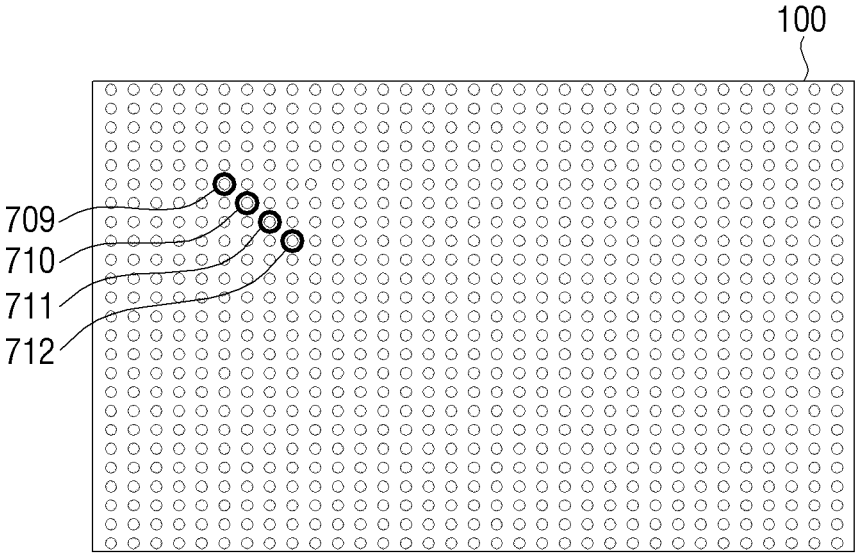
Figure 7D:
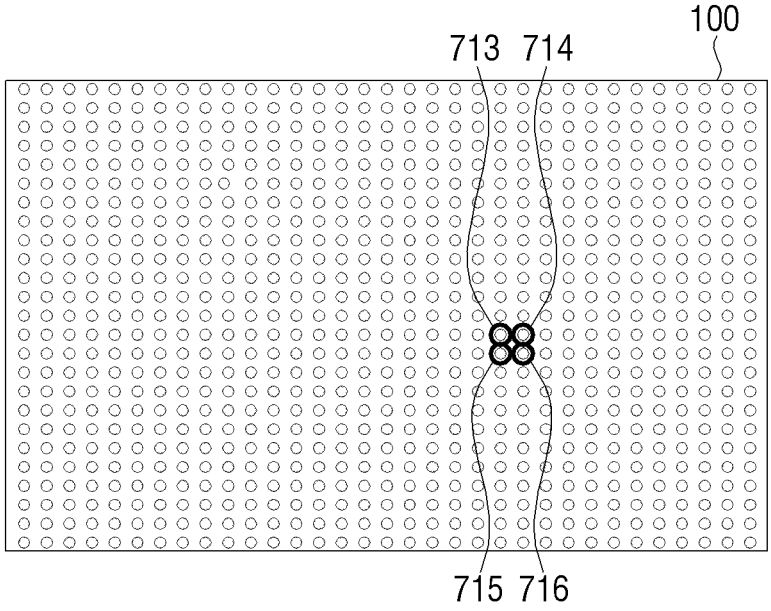

According to an exemplary embodiment, the controller 160, when the LED elements with detected errors which are adjacently disposed are in a number greater than or equal to a threshold value, may transmit notification information, to the operating terminal 200, using the communicator 150. FIGS. 7A-7D are views illustrating examples where the LED elements are adjacently disposed in a number greater than or equal to a threshold value. In the case when an error occurs at adjacent LED elements, reading information may be difficult or a user may be inconvenienced. For easier description, it will be assumed that the LEDs disposed in a horizontal direction corresponding to one LED line (or LED array) 121. However, one or more exemplary embodiments are not limited thereto, and, if the LED driving IC 130 is disposed in a vertical direction in a daisy chain configuration, the LEDs which are disposed in a vertical direction may correspond to one LED line (or LED array) 121. As illustrated in FIG. 7A, LED elements 701, 702, 703, and 704 correspond to the same LED line (or LED array) 121. As illustrated in FIG. 7B, errors occur at LED elements 705, 706, 707, 708 corresponding to the same output line 400. That is, errors occur at LED elements 705, 706, 707, 708 which are connected to a specific OUT channel of the LED driving IC 130. If, as illustrated in FIG. 7C, LED elements 709, 710, 711, 712 with errors are disposed in a diagonal direction, or if, as illustrated in FIG. 7D, LED elements 713, 714, 715, 716 with errors are clustered, whether or not notification information needs to be transmitted may be determined only after integrating and analyzing position information of multiple LED elements with errors.

Figure 8:
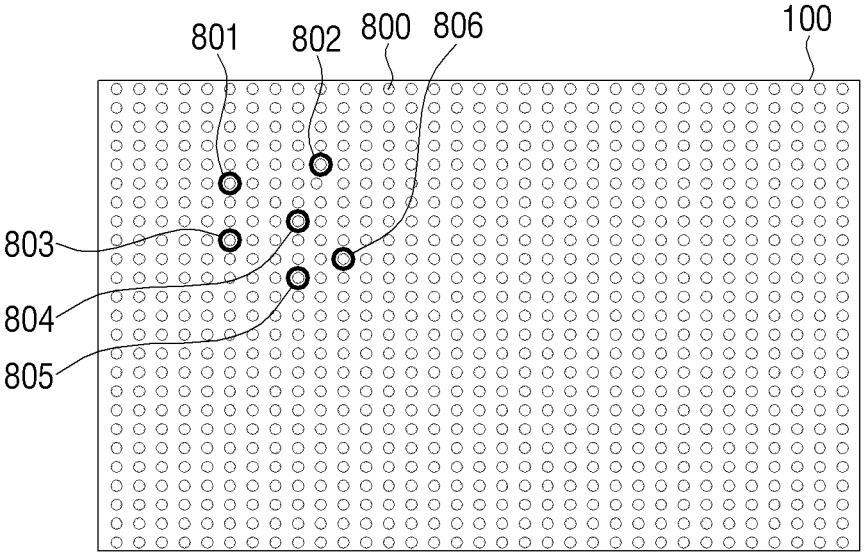

According to another exemplary embodiment, the controller 160, when the number of LED elements with errors disposed within a specific area, i.e., unit area is a number greater than or equal to a predetermined number, may transmit, to the operating terminal 200, notification information using the communicator 150. Referring to FIG. 8, although errors do not occur in adjacent LED elements, LED elements 801, 802, 803, 804, 805, 806 have errors and are gathered within a specific area, which may cause problems in reading information or visibility. Therefore, when the LED elements 801, 802, 803, 804, 805, 806 with errors in a number greater than or equal to a specific number are disposed in a specific unit area, notification information is transmitted to the operating terminal 200. A size or number of elements within the specific unit area may be set by a user. Alternatively, a preset size and number may be provided.

Figure 9:
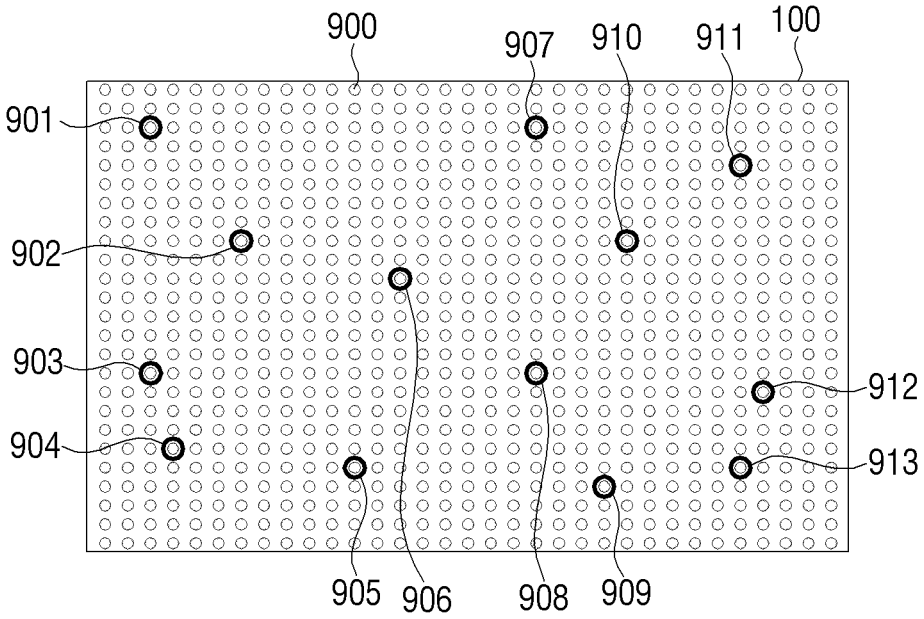

According to still another exemplary embodiment, when a total number of LED elements with errors are greater than or equal to a predetermined number, the controller 160 may transmit notification information to the operating terminal 200 using the communicator 150. Referring to FIG. 9, LED elements 901-913 have errors, but are not within a specific area, clustered, or adjacent. However, when errors occur in LED elements 901-913, which is greater than or equal to a predetermined number, notification information needs to be transmitted for repair. For example, if it is assumed that a preset number is 10, and the entire number of LED elements 901-913 with errors in FIG. 9 is 13, the controller 160 will transmit the notification information to the operating terminal 200.

Through the aforementioned LED display apparatus 100, it is possible to determine whether or not a repair is necessary remotely, and, thus, prompt and efficient management of the LED display apparatus 100 is possible.

Hereinbelow, referring to FIGS. 10 and 11, a method of error detection for the LED display apparatus having a plurality of LED lines which connect a plurality of LED elements in a row will be described.

Figure 10:
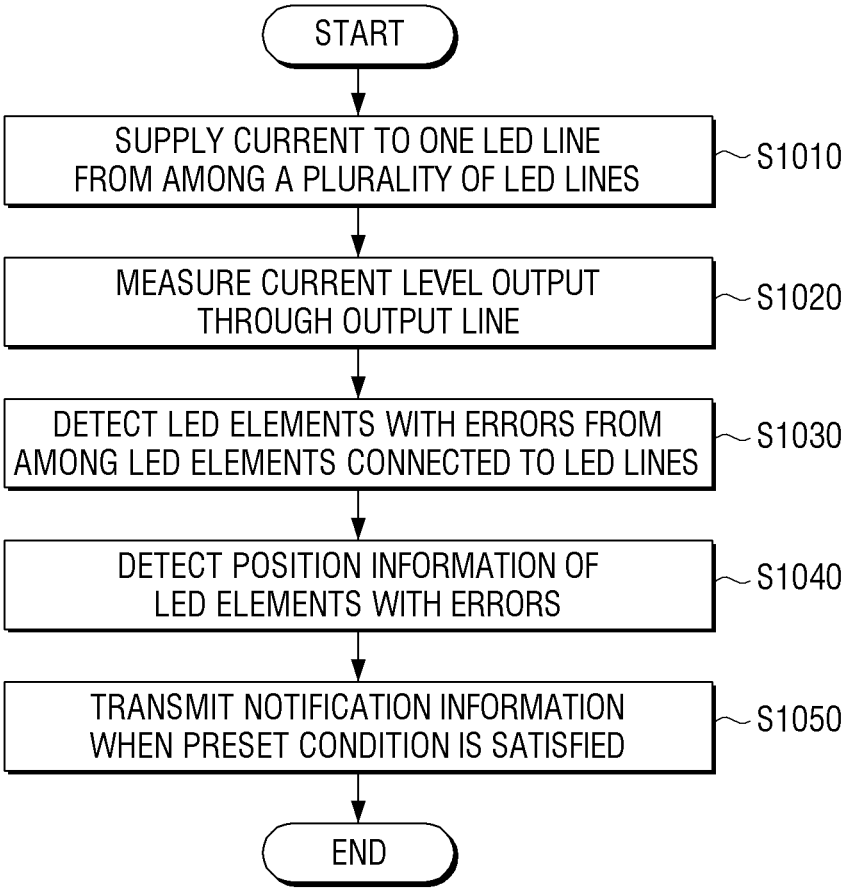
FIGS. 10 and 11 are flow charts describing an error detection method of an LED display apparatus according to various exemplary embodiments, and, FIGS. 12A to 12C are views for describing a method of compensating a reduction in average brightness according to another exemplary embodiment.

FIG. 10 is a flow chart describing an error detection method for LED elements of the LED display apparatus according to an exemplary embodiment. First of all, the LED display apparatus supplies current to one LED line (or LED array) from among a plurality of LED lines (S1010). Sequentially supplying current to each LED line (or LED array) is able to find out position of LED elements. In addition, a plurality of LED lines can be controlled by using one LED driving IC.

Then, a current level flowing in the LED elements line is measured through an output line (S1020). Anodes of a plurality of LED elements are connected in a row to an LED line (or LED array), and cathodes of a plurality of LED elements are connected in a row to an output line and connected to the LED driving IC. In the LED driving IC, a current level flowing in the LED elements may be measured through the connected output line.

Based on the current level flowing in the measured LED elements, LED elements with errors from among LED elements connected to the LED line (or LED array) are detected (S1030). For example, by comparing measured current with a threshold value, an error state of each LED element may be detected. As another example, an error state of the LED elements may be detected depending on whether or not current flows in the LED elements.

After detecting the LED elements with errors, position information of the LED elements is detected (S1040). For example, position information of each of LED elements may be detected based on an on/off state of a plurality of LED lines and an output state of a plurality of output lines. As another example, by not only detecting position information of the LED elements with errors but also comparing a current level flowing in all the LED elements with a threshold value and then digitalizing and transmitting the value to 0 or 1, an error occurrence pattern in the LED display apparatus may be recognized.

Based on position information of the LED elements with detected errors, when a disposition of the LED elements with errors satisfies a preset condition, notification information is transmitted (S1050). It is desirable that conditions to transmit notification information are determined based on whether or not A/S is necessary. Examples of transmission of notification information may include conditions where the detected LED elements are disposed adjacently in a number greater than or equal to a preset number, the number of LED elements with errors within a unit area is greater than or equal to a preset number, and the total number of LED elements with errors is greater than or equal to a preset number. In addition to the above-described examples, a user may set a specific condition in response to which the notification information may be transmitted.

Figure 11:
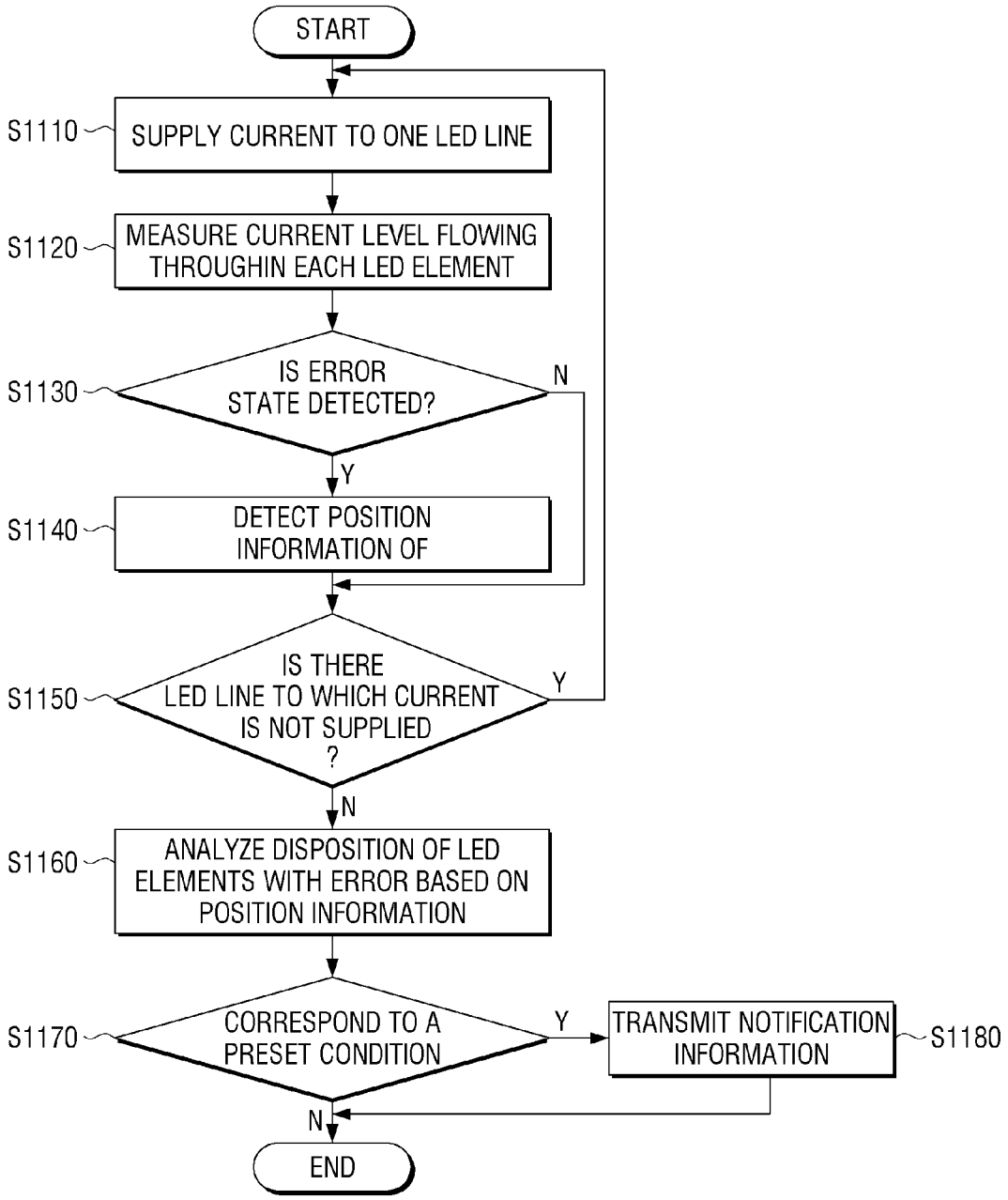

FIG. 11 is a flow chart describing an error detection method in LED elements of the LED display apparatus according to another exemplary embodiment. First of all, the step of supplying current to one LED line (or LED array) is executed (S1110). By controlling a switch corresponding to each LED line (or LED array), current can be supplied to only one LED. Next, the step of measuring a current level which flows in each LED element provided on the LED line supplied with current is executed (S1120). For example, a current level which is output through an output line connected to cathodes of the LED element may be measured. By using a method to compare a current level measured in the step of measuring with a threshold value, the step of detecting an error state of each LED element is executed (S1130). When it is detected that an error occurs (S1130-Y), the step of detecting position information of the LED elements with errors is executed (S1140). In case of the LED elements S1130-N without errors, position information is not detected. However, in another exemplary embodiment, position information of the LED elements without errors may be detected and provided along with position information of the LED elements with errors. When current is sequentially supplied to a plurality of LED lines, and there are LED lines to which current is not supplied (S1150-Y), the step is back to S1110, and the steps of supplying and measuring are repeated. When all lines have been sequentially supplied current (S1150-N), disposition of the LED elements with errors are analyzed based on the detected position information (S1160). The reason why such analysis is required is that, even when there are LED elements with errors, if there is no problem related to visibility, A/S is not necessary, and, consequently, it is not necessary to transmit notification information. By using the disposition of the LED elements with the analyzed errors, whether the condition corresponds to a preset condition is determined (S1170). The preset conditions may include conditions where the detected LED elements with errors are disposed adjacently in a number greater than or equal to a preset number, the number of detected LED elements with errors within a unit area is in number greater than or equal to a preset number, and the total number of detected LED elements with errors is greater than or equal to a preset number. When one or more of the conditions are satisfied (S1170-Y), notification information is transmitted. Notification information may include at which LED element errors occur, in addition to information indicating that A/S is necessary.

According to one or more above-described various exemplary embodiments, correct position information of the LED elements with errors in the LED display apparatus can be identified, and whether or not a repair is necessary can be determined. If it is determined that a repair is necessary, notification information can be transmitted, and, thus, efficient management is provided.

According to another exemplary embodiment, a method of compensating a decrease in brightness in LED elements with errors, that is, dead pixels through other LED elements may be provided.

Figure 12A:
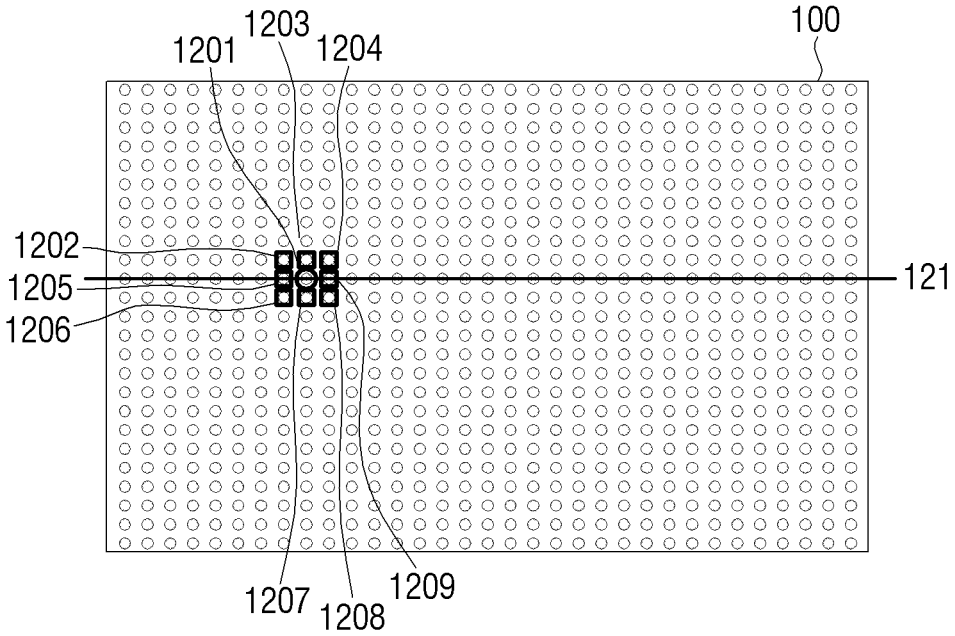

FIG. 12A is a view illustrating a case to increase brightness of LED elements 1202-1209 at a specific level to compensate for a decrease in average brightness by the LED element 1201 with an error. An accurate position of the LED elements 1201 with an error may be provided by the above-described one or more exemplary embodiments. In addition, position of nearby LED elements 1202-1209 can be known based on position information of LED element 1201, and, thus, the brightness of nearby LED elements 1202-1209 may be adjusted only using timing control block 510 of the LED driving IC 130.

Figure 12B:
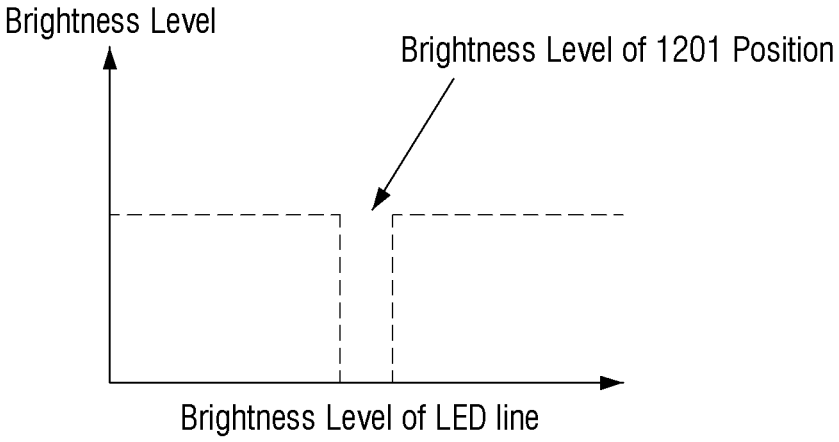

FIG. 12B is a graph illustrating a brightness level of the LED line 121 including the LED element 1201 with errors before compensating brightness. For ease of understanding, the color of the LED elements can be presumed to be white, but this is merely an example. As illustrated in FIG. 12B, it is identified that brightness level is reduced only at a position where the LED element 1201 with the error is located, that is, a dead pixel. As such, when a brightness level is not regular, a screen provided by the LED display apparatus 100 may have a visibility problem. When it is not possible to provide A/S or self-recovery is available without A/S, a brightness of nearby LED elements can be increased to reach a certain brightness level.

Figure 12C:
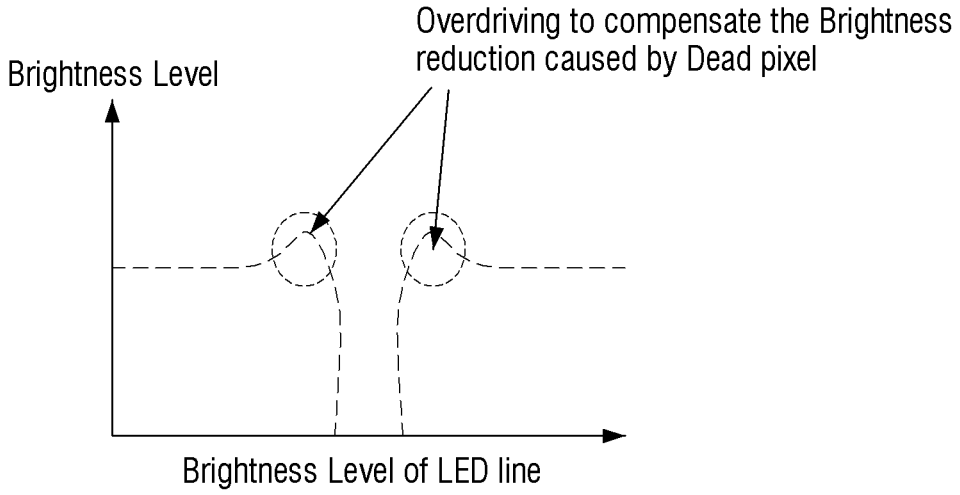

FIG. 12C is a graph illustrating brightness level of the LED line 121 after compensating brightness. Referring to FIG. 12C, the brightness level of the LED elements 1202-1209 around the dead pixel 1201 is increased compared to an average brightness level. Accordingly, the dead pixel 1201 may be compensated, and, consequently, a user of the LED display apparatus 100 may view a screen provided by the LED display apparatus 100 without inconvenience even if A/S is not provided.

Various methods may be used to adjust a brightness of nearby LED elements 1202-1209. For example, if original brightness of the LED element 1201 with errors is called L(i,j), a total of brightness level which is increased by nearby LED elements 1202-1209 can equal to L(i,j). In other words, if total compensated brightness difference is ΔL, it can be expressed as Equation 1 shown below. For ease of description, i and j values represent a position coordinate value in the LED display apparatus 100. For example, L(i,j) indicates brightness of an element connected to $i^{th}$ output line 400-*i* from among $j^{th}$ LED line 121-*j*.

$$\Delta L(i-1,j+1)+\Delta L(i,j+1)+\Delta L(i+1,j+1)+\Delta L(i-1,j)+\Delta L(i+1,j)+\Delta L(i-1,j-1)+\Delta L(i,j-1)+\Delta L(i+1,j-1)=L(i,j) \quad \text{(Equation 1)}$$

Alternatively, the adjustment in brightness of the nearby LED elements 1201-1209 may be greater than or less than the original brightness of LED element 1201.

As still another example, nearby LED elements can include LED elements 2-pixels or 3-pixels from the LED element 1201, instead of selecting only LED elements within 1-pixel, as illustrated in FIG. 12A. In this case, nearby LED elements closer to the dead pixel 1201 may have a greater brightness compensation ratio than more distant nearby LED elements. However, the embodiments will not be limited thereto, and a preset compensation ratio may be applied based on various requirements.

A method of error detection according to the aforementioned various exemplary embodiments may be embodied as a program and provided to the LED display apparatus.

As an example, a non-transitory computer readable medium stored with a program which enables executing, for each of a plurality of LED lines, the steps of supplying current to one LED line from among the plurality of LED lines, measuring a current level flowing through the LED line, and detecting the LED elements with errors from among the LED elements connected to the LED line may be provided.

Specifically, a non-transitory computer readable medium which stores a program including a controlling method of a user terminal device may be provided.

The non-transitory recordable medium refers to a medium which may store data semi-permanently rather than storing data for a short time such as a register, a cache, and a memory, and may be readable by an apparatus. For example, the non-transitory readable medium may be CD, DVD, hard disk, Blu-ray disk, USB, memory card, ROM, etc.

The foregoing exemplary embodiments and advantages are merely exemplary and are not to be construed as limiting the present invention. The present teaching can be readily applied to other types of apparatuses. Also, the description of one or more exemplary embodiments is intended to be illustrative, and not to limit the scope of the claims, and many alternatives, modifications, and variations will be apparent to those skilled in the art.

What is claimed is:

1. A light emitting diode (LED) display apparatus, comprising:

a plurality of LED lines, each of the plurality of LED lines comprising a plurality of LEDs;

a plurality of switches connected to respective LED lines among the plurality of LED lines;

a controller configured to sequentially supply power to each of the plurality of LED lines one at a time by sequentially turning on and off the plurality of switches; and an LED driver configured to identify an error state of an LED from the plurality of LEDs by estimating current flowing through the plurality of LED lines, and to provide the controller with a result of the identification, wherein the controller is further configured to compensate for the LED having the error by controlling an adjustment of power supplied to LEDs adjacent to the LED having the error from among the plurality of LEDs, wherein the each of the plurality of LEDs comprises an anode and a cathode, wherein each of the plurality of LED lines is connected to the anode of each the plurality of LEDs included in the each of the plurality of LEDs, wherein the LED driver is connected to a plurality of output lines which are connected to the cathode of each of the plurality of LEDs, and wherein the controller identifies position information of the plurality of LEDs based on an on/off state of each of the plurality of LED lines and an output state of each of the plurality of output lines.

2. The LED display apparatus as claimed in claim 1, wherein the LED driver is configured to compare a current level output through the plurality of connected output lines with a threshold current value, and identify the error state of the LED based on a result of the comparison.

3. The LED display apparatus as claimed in claim 1, further comprising a communicator configured to communicate with an operating terminal, wherein the controller is further configured to, in response to the result of the identification indicating that a plurality of LEDs of the plurality of LEDs have an error and the plurality of LEDs having the error being adjacently disposed in a number greater than a predetermined number, control the communicator to transmit notification information to the operating terminal.

4. The LED display apparatus as claimed claim 1, further comprising:

a communicator configured to communicate with an operating terminal, wherein the controller is further configured to, in response to the result of the identification indicating that a plurality of LEDs of the plurality of LEDs have an error and the plurality of LEDs having the error being disposed in a number greater than a predetermined number within a unit area, control the communicator to transmit notification information to the operating terminal.

5. The LED display apparatus as claimed in claim 1, further comprising:

a communicator configured to communicate with an operating terminal, wherein the controller is further configured to, in response to the result of the identification indicating that a plurality of LEDs of the plurality of LEDs have an error and a number of the plurality of LEDs having the error being greater than a predetermined number, control the communicator to transmit notification information to the operating terminal.

6. The LED display apparatus as claimed in claim 1, wherein the LED driver comprises an LED driving integrated circuit (IC).

7. An error identification method of an LED display apparatus comprising a plurality of LED lines, each of the plurality of LED lines, which connect a plurality of LEDs in a row, the method comprising:

supplying current to one LED line from among a plurality of LED lines by switching an on/off state of the plurality of LED lines;

measuring a current level which enters through the LED line;

identifying an LED where an error occurs from among the plurality of LEDs connected to the LED line, wherein the supplying, the measuring, and the identifying are carried out sequentially for the plurality of LED lines; and adjusting power supply to LEDs adjacent to the LED having the error from among the plurality of LEDs, wherein the each of the plurality of LEDs comprises an anode and a cathode, wherein each of the plurality of LED lines is connected to the anode of each the plurality of LEDs included in the each of the plurality of LEDs, wherein the measuring comprises measuring a current level output through a plurality of output lines which are connected to the cathode of each of the plurality of LEDs, and wherein the identifying comprises identifying position information of the plurality of LEDs based on the on/off state of each of the plurality of LED lines and an output state of each of the plurality of output lines.

8. The error identification method as claimed in claim 7, wherein the identifying comprises comparing the current level measured through the plurality of output lines with a threshold value and identifying an error state of the LED based on a result of the comparison.

9. The error identification method as claimed in claim 7, further comprising transmitting, in response to identifying that a plurality of LEDs of the plurality of LEDs have an error and the plurality of LEDs having the error being adjacently disposed in a number greater than a threshold number, notification information to an operating terminal.

10. The error identification method as claimed in claim 7, further comprising:

transmitting, in response to identifying that a plurality of LEDs have an error and the plurality of LEDs having the error being disposed in a number greater than a predetermined number within a unit area, notification information to an operating terminal.

11. The error identification method as claimed in claim 7, further comprising:

transmitting, in response to identifying that a plurality of LEDs of the plurality of LEDs have an error and a number of the plurality of LEDs having the error being greater than a predetermined number, transmitting notification information to an operating terminal.

12. A light emitting diode (LED) display, comprising:

a plurality of LED lines, each of the plurality of LED lines comprising a plurality of LEDs;

a plurality of switches connected to a respective LED line among the plurality of LED lines; and a controller configured to sequentially switch the plurality of switches to control a supply of power to the each of the plurality of LED lines one at a time, identify a current flowing through the plurality of LED lines, and determine whether an LED from among the respective pluralities of LEDs has an error, wherein the controller is further configured to compensate for the LED having the error by controlling an adjustment of power supplied to LEDs adjacent to the LED having the error from among the plurality of LEDs, wherein the each of the plurality of LEDs comprises an anode and a cathode, wherein each of the plurality of LED lines is connected to the anode of each the plurality of LEDs included in the each of the plurality of LEDs, wherein the cathode of each of the plurality of LEDs is connected to a plurality of output lines, wherein the controller identifies location information of the plurality of LEDs based on an on/off state of each of the plurality of LED lines and an output state of each of the plurality of output lines.

13. The LED display as claimed in claim 12, wherein the controller is further configured to, in response to determining that a plurality of LEDs among the plurality of LEDs have the error, determine whether a repair is necessary.

14. The LED display as claimed in claim 12, wherein the controller is further configured to, in response to determining that a plurality of LEDs among the plurality of LEDs have the error, determine whether a repair in necessary based on an arrangement of the plurality LEDs having the error.

15. The LED display as claimed in claim 14, wherein the controller is further configured to determine the location information of the plurality of LEDs having the error based on a state of the plurality of switches and the identified current flowing through the respective LED lines, and to determine the arrangement of the plurality of LEDs having the error based on the determined location information.

16. The LED display as claimed in claim 12, wherein the controller is further configured to determine the location information of the LED having the error based on a state of the plurality of switches and the identified current flowing through the respective LED lines, and to determine the adjacent LEDs based on the determined location information.

* * * * *